US006469444B1

(12) United States Patent
Leng et al.

(10) Patent No.: US 6,469,444 B1
(45) Date of Patent: Oct. 22, 2002

(54) LAMP WITH IMPROVED COLOR RENDERING

(75) Inventors: Yongzhang Leng, Damascus, MD (US); James T. Dolan, Frederick, MD (US); Bruce Shanks, Gaithersburg, MD (US)

(73) Assignee: Fusion Lighting, Inc., Rockville, MD (US)

( * ) Notice: Subject to any disclaimer, the term of this patent is extended or adjusted under 35 U.S.C. 154(b) by 0 days.

(21) Appl. No.: 09/647,528

(22) PCT Filed: Jun. 3, 1999

(86) PCT No.: PCT/US99/11782

§ 371 (c)(1),
(2), (4) Date: Oct. 2, 2000

(87) PCT Pub. No.: WO99/65052

PCT Pub. Date: Dec. 16, 1999

Related U.S. Application Data

(60) Provisional application No. 60/089,052, filed on Jun. 12, 1998.

(51) Int. Cl.[7] ..... H01J 17/20; H01J 61/12; H01J 61/18

(52) U.S. Cl. ..... 313/637; 313/638

(58) Field of Search ..... 313/637, 638, 313/639, 634–36, 484–93, 567–568, 572, 573; 315/248, 267–68, 344; 362/345

(56) References Cited

U.S. PATENT DOCUMENTS

| | | | | |
|---|---|---|---|---|
| 3,852,630 A | 12/1974 | Wesselink et al. | ..... | 313/228 |
| 4,027,190 A | 5/1977 | Shintani et al. | ..... | 313/229 |
| 4,360,758 A | 11/1982 | Thornton, Jr. et al. | ..... | 313/227 |
| 4,742,268 A | 5/1988 | Caruso et al. | ..... | 313/620 |
| 4,801,846 A | 1/1989 | Kramer et al. | ..... | 313/641 |
| 5,404,076 A | 4/1995 | Dolan et al. | ..... | 313/572 |
| 5,661,365 A | 8/1997 | Turn | ..... | 313/637 |
| 5,688,064 A | 11/1997 | Shanks | ..... | 403/24 |
| 5,773,918 A | 6/1998 | Dolan et al. | ..... | 313/113 |

FOREIGN PATENT DOCUMENTS

| | | | |
|---|---|---|---|
| EP | 0 271 911 | 6/1998 | ..... H01J/61/12 |
| WO | 93/21655 | 10/1993 | ..... H01J/61/38 |

OTHER PUBLICATIONS

"Vapor–phase Complex Formation of Metal Halides and its Application in High Pressure Discharge Lamps" by L. Rehder and I. Wilson, *Proceedings of the Symposium on High Temperature Metal Halide Chemistry* (1978, pp. 71–79).

"Metal halide vapour complxes: vapour transport and lamp experiments" by D.S. McPhail, et al. *Journal of Materials Science* 20 (1985) 457–466.

*Primary Examiner*—Michael H. Day
*Assistant Examiner*—Mack Haynes
(74) *Attorney, Agent, or Firm*—Paul E. Steiner

(57) ABSTRACT

A discharge lamp for providing visible radiation includes a lamp envelope which is made of light transmissive material a fill in the envelope including either calcium halide or strontium halide together with either elemental sulfur or elemental selenium in gaseous form which is obtainable when the fill is excited by sufficient power in operation, in an amount such that the excited fill emits a discharge of visible radiation from the fill with substantially all of the radiation being molecular radiation which is emitted in the visible region of the spectrum. The calcium halide or strontium halide operates at a vapor pressure which provides a significant amount of radiation in the red region of the spectrum therefrom and the overall spectrum has a color rendering index of about 87 or more.

13 Claims, 10 Drawing Sheets

LAMP WITH IMPROVED COLOR RENDERING

This invention was made with Government Support under Contract No. NAS10-12114 awarded by the National Aeronautics and Space Administration. The Government has certain rights in this invention.

BACKGROUND

1. Field of the Invention

The present invention is directed to a sulfur, selenium, and/or tellurium lamps having improved color rendering.

2. Related Art

The invention relates to sulfur selenium and/or tellurium lamps (hereinafter the "subject lamps"), such as those described in U.S. Pat. Nos. 5,404,076, 5,661,365, and 5,688,064, each of which is herein incorporated by reference in its entirety. In the subject lamps, elemental sulfur, selenium and/or tellurium is present in gaseous form, which is obtainable when the fill is excited by sufficient power, in an amount such that the excited fill emits a discharge of visible radiation from the fill component with substantially all of such radiation being molecular radiation which is emitted in the visible region of the spectrum. The subject lamps disclosed in the above-mentioned patents are discharge lamps, and may be either of the electrodeless type where the discharge is excited by microwave or RF power, or of the electroded type where the discharge is excited by an electrical voltage across the electrodes.

The subject lamps are highly efficient for visible lighting with good color rendering. By way of comparison, the color rendering index (CRI) for a sulfur lamp is about 80, as opposed to a CRI of about 70 for the metal halides lamps, a CRI of about 62 for fluorescent lamps, and a CRI of about 22 for high pressure sodium lamps. A lamp with a CRI equal to or higher than about 90 would be considered a high quality color rendering lamp.

The addition of metal halides to HID lamps is a common practice in the lighting industry. For most metal halide additives, the metal atoms are excited, ionized and then radiate at the desired spectral region. This visible radiation from excited atoms is typically accompanied by unwanted infrared line radiation which leads to lower efficacy. Optimizing the color of metal halide lamps is accomplished by changing the ratio of other metal halides to provide sufficient amounts of the blue and green radiation. For example, U.S. Pat. Nos. 3,852,630, 4,360,758, 4,742,268, 4,027,190, and 4,801,846 disclose that calcium, strontium and aluminum halides can be used with mercury containing metal halide lamps to bring up the red output to increase the CRI.

If a CRI of about 90 could be achieved for the subject lamps without substantially lowering the efficacy, excellent lamps for a wider variety of lighting applications would result. The subject lamps produce visible light efficiently through self absorption of ultraviolet radiation in an optically thick plasma. Any attempt to increase the CRI, however, is limited by the full width of half maximum (FWHM) of the visible spectrum of the lamps. In other words, an increase in red radiation results in a loss of blue radiation, thereby lowering the CRI. Blue or green radiation cannot be substantially increased by introducing metal halides into sulfur plasma, because sulfur molecules have strong self absorption in those regions.

SUMMARY

In accordance with a first aspect of the present invention, calcium and/or strontium halide is added to the fill of a sulfur, selenium, and/or tellurium lamp to improve the color rendering index. Optionally, an inert starting gas such as argon, xenon, or krypton is also included in the fill.

In accordance with a further aspect of the invention a metal halide volatilizer is also added to the fill to increase the vapor pressure of the calcium or strontium halide.

In accordance with another aspect of the invention, a sulfur lamp with a calcium halide additive surprisingly maintains a high CRI after over several thousands hours of lamp operation.

In one embodiment of the invention, a discharge lamp bulb for providing visible radiation includes a lamp envelope which is made of light transmissive material. A fill in the envelope includes at least one first member selected from the group consisting of calcium halide and strontium halide, and at least one second member selected from the group consisting of elemental sulfur and elemental selenium in gaseous form which is obtainable when the fill is excited by sufficient power in operation, in an amount such that the excited fill emits a discharge of visible radiation from the selected members with substantially all of the radiation being molecular radiation which is emitted in the visible region of the spectrum. The calcium halide may be one of $CaBr_2$, $CaI_2$, and $CaCl_2$, and the strontium halide may be one of $SrBr_2$, $SrI_2$, and $SrCl_2$.

Preferably, the concentration of the sulfur, if present in the fill, is between about 0.1 mg/cc and 5 mg/cc, the concentration of the selenium, if present in the fill, is between about 0.05 mg/cc and 2 mg/cc, and the concentration of each of $CaBr_2$ and $SrBr_2$ is between about 0.001 mg/cc and 1 mg/cc. The fill may also include a metal halide volatilizer including at least one of aluminum halide, gallium halide, germanium halide, indium halide, tin halide, and iron halide, or compounds thereof. If so, the concentration of each metal halide volatilizer compound is between about 0.01 mg/cc and 2 mg/cc.

The lamp may be electrodeless or electroded and is preferably used in combination with means for exciting a discharge in the fill, which may include, for example, means for generating microwave or RF power and means for coupling the microwave or RF power to the fill.

BRIEF DESCRIPTION OF THE DRAWINGS

The invention will be better understood with reference to the following description and the drawings wherein:

FIG. 11 A is a graph of CRI over several thousand hours of lamp operation for the lamp of FIG. 11;

DESCRIPTION

Molecular radiation from calcium halide occurs at longer wavelengths (around 625 nm) and does not need self absorption. Energy transferring from the radiating plasma will have a higher radiation efficiency. Therefore, doping a very small amount of calcium bromide provides sufficient long wavelength radiation to improve the CRI of sulfur and/or selenium lamps from about 80 to over 90. $CaBr_2$ doping does not, however, substantially change the plasma conditions (e.g., electron density and electron temperature) which are dominated by the primary fill component molecules (e.g. sulfur, selenium, and/or tellurium).

Although calcium and strontium halides are known additives for mercury-based discharge lamps, it cannot be predicted that similar additives will work in the plasma environment of a sulfur/selenium lamp. In high pressure sodium lamps, for example, increasing the sodium pressure provides an increase in red radiation. However, adding sodium halides to sulfur lamps improves CRI insignificantly, if at all. In addition, the addition of sodium halides lowers the efficacy due to the extra infrared radiation from increasing sodium pressure. The above-mentioned U.S. Pat. No. 5,404,076 discloses adding cadmium iodide ($CdI_2$) to sulfur plasma to increase the red radiation of the plasma and observed that its spectrum has a shoulder at 580 nm, which is caused by the CdS and another shoulder at 650 nm, which is caused by the $CdI_2$. However, adding $CdI_2$ does not improve the CRI significantly. Moreover, calcium forms compounds with sulfur, selenium, and tellurium (e.g. CaS, CaSe, and CaTe) which are solid (CaS is actually a rock known by the common name of natural old hamite) and would not dissociate to participate in the discharge under normal lamp operating conditions.

Figure 1:
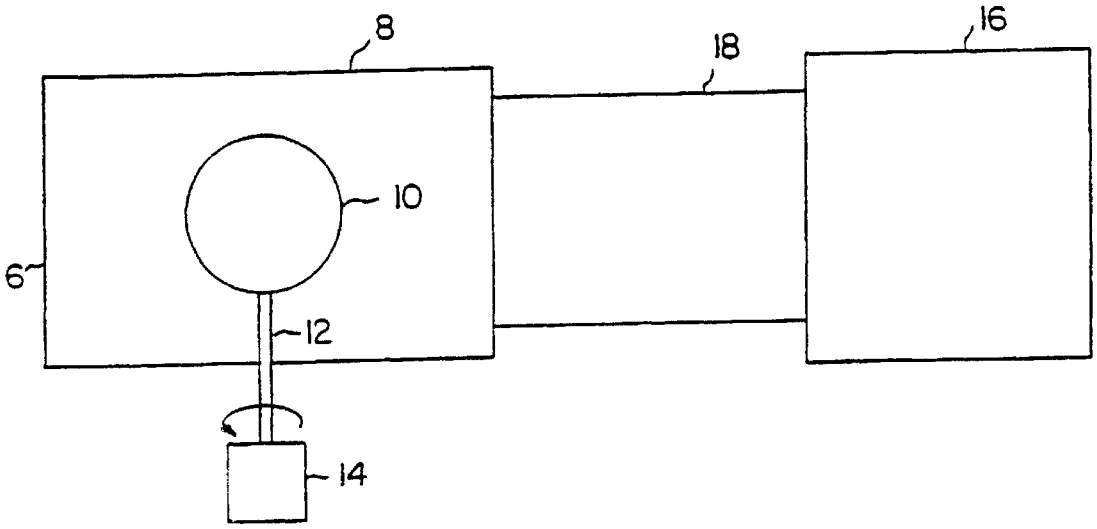
FIGS. 1 to 3 show embodiments of prior art lamps, which are improved by the present invention.

Referring to FIG. 1, a lamp is depicted which is an embodiment of the invention which is powered by microwave energy, it being understood that RF energy may be used as well. The lamp includes a microwave cavity which is comprised of a metallic cylindrical member 6 and a metallic mesh 8. The mesh 8 is effective to allow the light to escape from the cavity while retaining the microwave energy inside. A spherical bulb 10 is disposed in the cavity and is supported by a stem 12. The stem 12 is connected with a motor 14 for effecting rotation of the bulb 10, which promotes stable operation of the lamp. Microwave energy is generated by a magnetron 16, and a waveguide 18 transmits such energy to a slot (not shown) in the cavity wall, from where it is coupled to the cavity and particularly to the fill in the bulb 10.

The bulb 10 includes a bulb envelope and a fill in the envelope. Elemental sulfur or a sulfur compound from which elemental sulfur can be obtained upon excitation and/or elemental selenium or a selenium compound from which elemental selenium can be obtained upon excitation is included in the lamp fill in an amount such that when the fill is excited with sufficient power in operation, it emits visible radiation, with substantially all of the radiation resulting from the elemental sulfur or selenium being molecular radiation which is emitted in the visible region of the spectrum.

Sulfur compounds which may be used in the unexcited fill include $CS_2$, InS, $As_2S_3$ and selenium compounds which may be used include HgSe, $SeO_2$, $SeCl_4$. Additional compounds which may be used are those which have a sufficiently low vapor pressure at room temperature, i.e., are a solid or a liquid, and which have a sufficiently high vapor pressure at operating temperature to provide useful illumination.

The microwave or RF powered lamps described herein may be operated at a variety of power densities, for example those between about 5 watts/cc and a thousand or more watts/cc, it being understood that the power must be sufficient to vaporize the sulfur and/or selenium fill and create a pressure which results in the emission of radiation therefrom, substantially all of which is in the visible region. The particular power density which is used in any application will depend upon the amount of fill used, the size of the bulb, and the required lumen output of the lamp.

Figure 2:
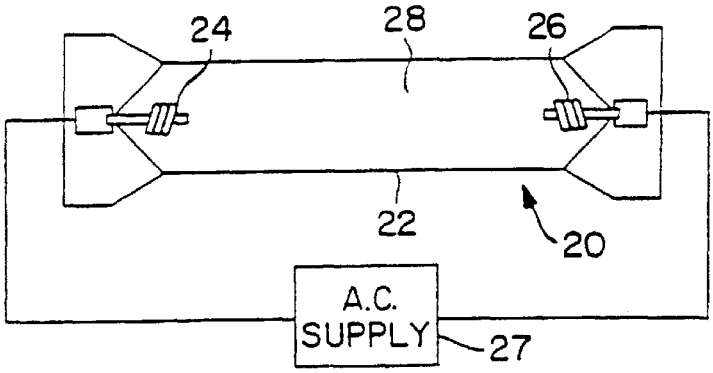

FIG. 2 shows another embodiment, which includes an arc lamp 20 comprised of a quartz envelope 22 having electrodes 24 and 26, and containing a fill 28. To excite the fill 28, an electrical voltage from a source 23 is impressed across the electrodes 24 and 26, whereupon an arc discharge occurs therebetween. The fill 28 in envelope 22 is as described herein above for the electrodeless lamp embodiments, while the lamp would typically be excited at normal power densities for metal halide arc lamps. The electrodes 24 and 26 may be made of or plated with a special material such as platinum to prevent or minimize chemical reactions with the fill gas.

A preferred embodiment for exciting a fill according to the present invention is the Light Drive™ 1000 lamp, made by Fusion Lighting, Inc., Rockville, Md. The structure of this lamp is shown schematically in FIG. 3. A magnetron 41 generates microwave energy and radiates the energy from an antenna 42. A waveguide 43 directs the microwave energy to a coupling slot 45. The microwave energy excites a fill in the bulb 46. A microwave cavity is defined by a screen 49 which includes a cylindrical mesh section and a cylindrical solid section 51. The screen 49 is fitted around a flange 53 with the bulb 46 and a reflector 57 inside the cavity defined by the screen 49. The screen 49 is secured to the flange 53 on the lamp housing with a clamp.

Figure 3:
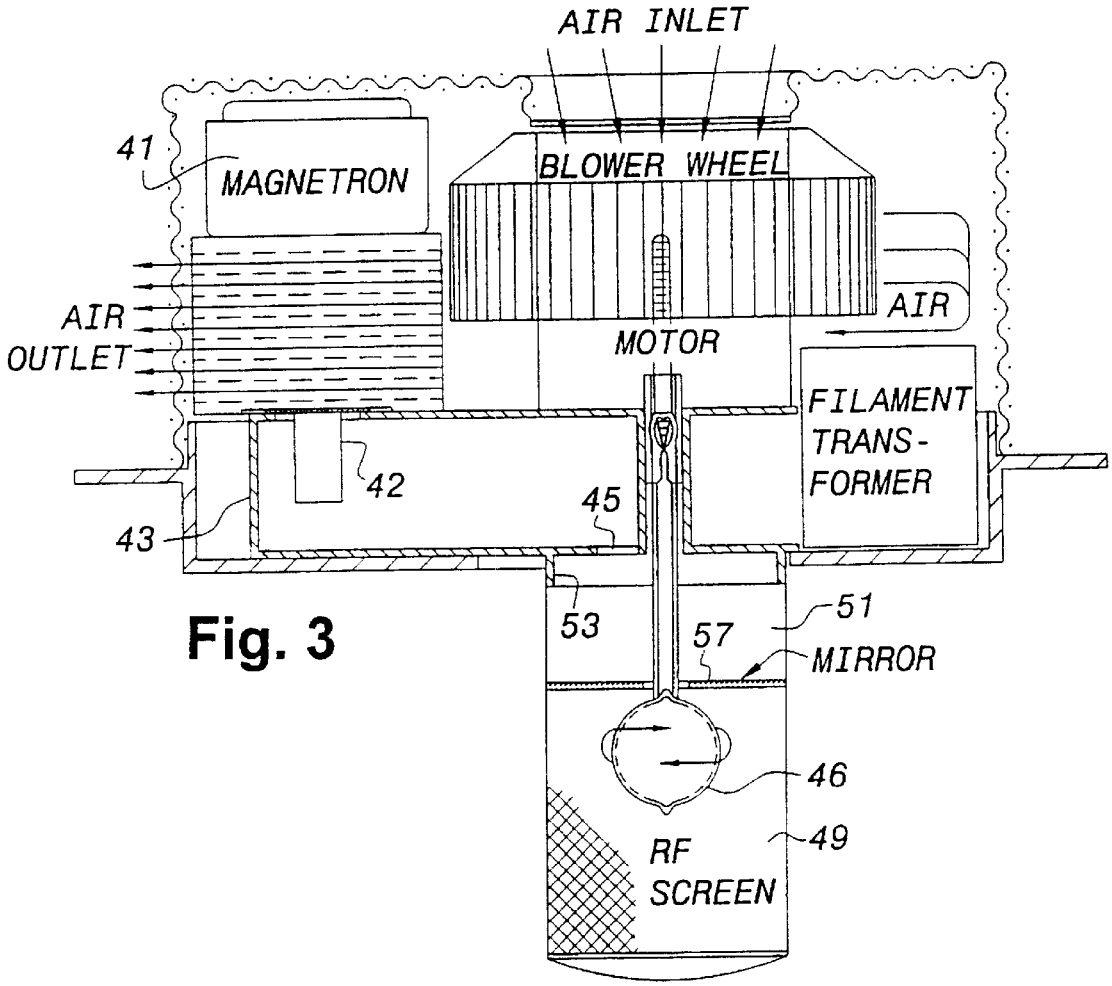
Figure 4:
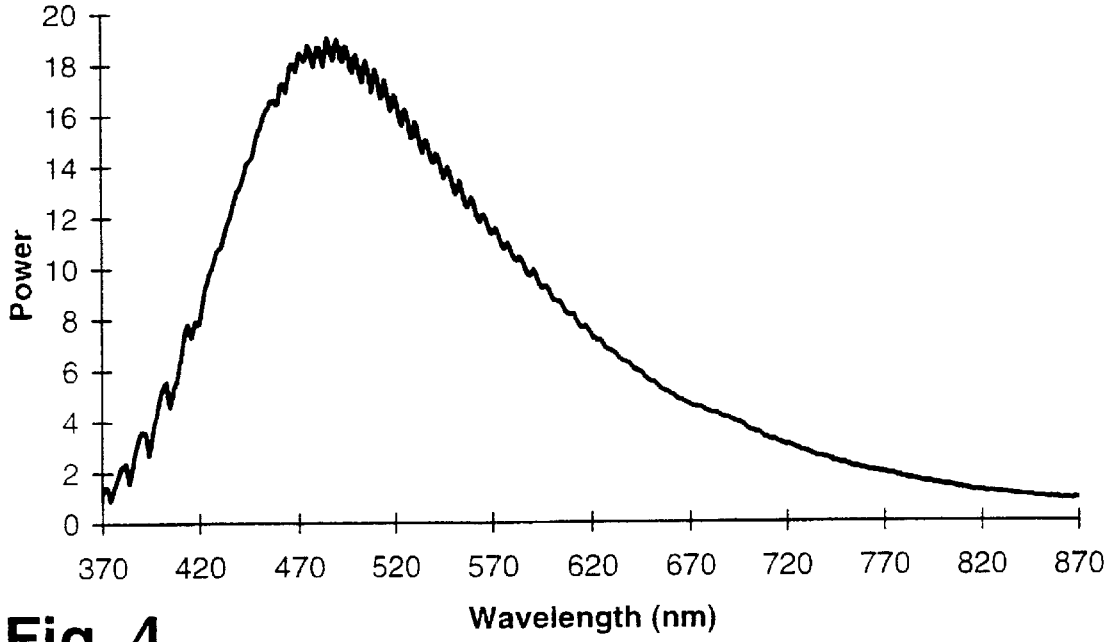
FIG. 4 is a graph of a spectrum of emitted light for a prior art sulfur lamp.

FIG. 4 shows the spectrum of light which is emitted by a sulfur lamp as shown in FIG. 3, having a fill containing sulfur at a concentration of about 1.38 mg/cc. As can be seen from FIG. 4, molecular radiation is present throughout the visible region, and the lamp has a good CRI of about 80.

Figure 5:
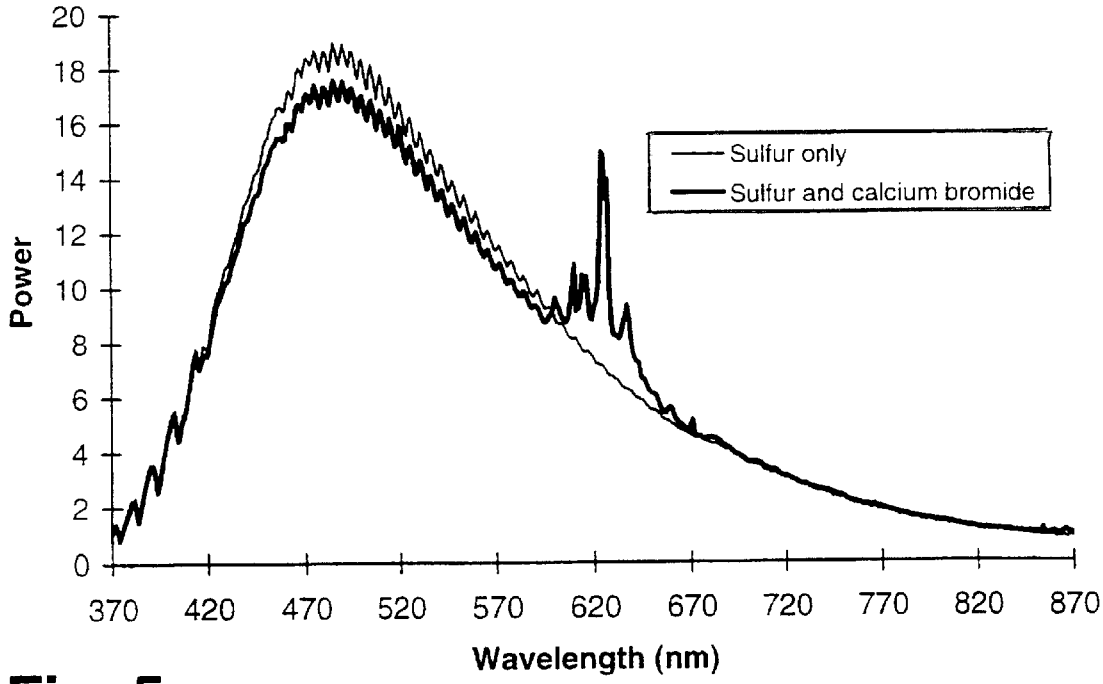
FIG. 5 is a comparison of the spectrum of FIG. 4 with that obtained for a lamp having a sulfur and $CABr_2$ fill.

As discussed above, in accordance with the present invention, the CRI is significantly improved by adding calcium halide and/or strontium halide to the fill. Referring to FIG. 5, the thin graph line is a repetition of the spectrum depicted in FIG. 4, while the thick graph line is a spectrum of a bulb containing sulfur in about the same concentration (about 1.38 mg/cc S) and calcium halide (about 0.1 mg/cc $CaBr_2$). Both fills are excited with about the same microwave power. The calcium halide doped bulb has almost same bulb temperature as the sulfur-only bulb. The increase in red radiation in the calcium halide doped sulfur fill is notable.

The visible radiation from sulfur molecules utilizes the strong self absorption in ultraviolet and violet regions, and weak self absorption in blue and green regions. Therefore, the blue radiation from calcium bromide is obscured and dominated by the strong sulfur radiation. Shifting radiation from the blue to the red is successful without any significant increase in the infrared region.

Figure 6:
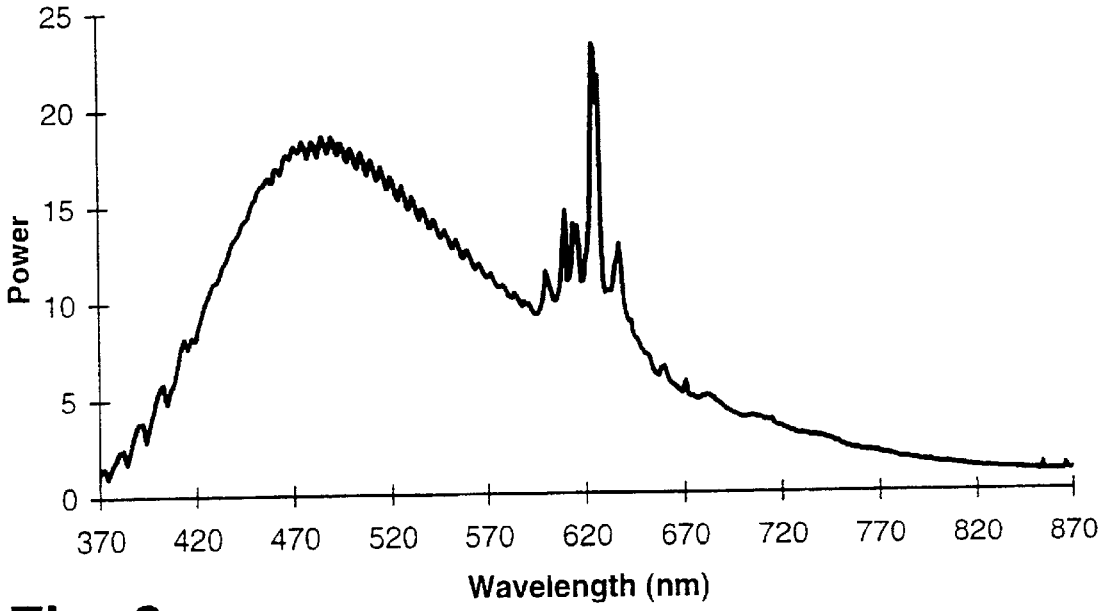
FIG. 6 is a graph of the spectrum of a sulfur/$CaBr_2$ bulb operated at a slightly higher microwave power than the bulb of FIG. 5.

FIG. 6 shows the spectrum of a sulfur/calcium bromide bulb (about 1.1 mg/cc S, about 0.1 mg/cc $CaBr_2$) operated at a slightly higher microwave power (about 964 watts), as compared to the lamp described in connection with FIG. 5, and therefore a higher bulb temperature (about 963° C.). A significant increase in red radiation is obtained from the calcium bromide. The bulb CRI is as high as about 93, and all of the eight indices are above 90.

Figure 7:
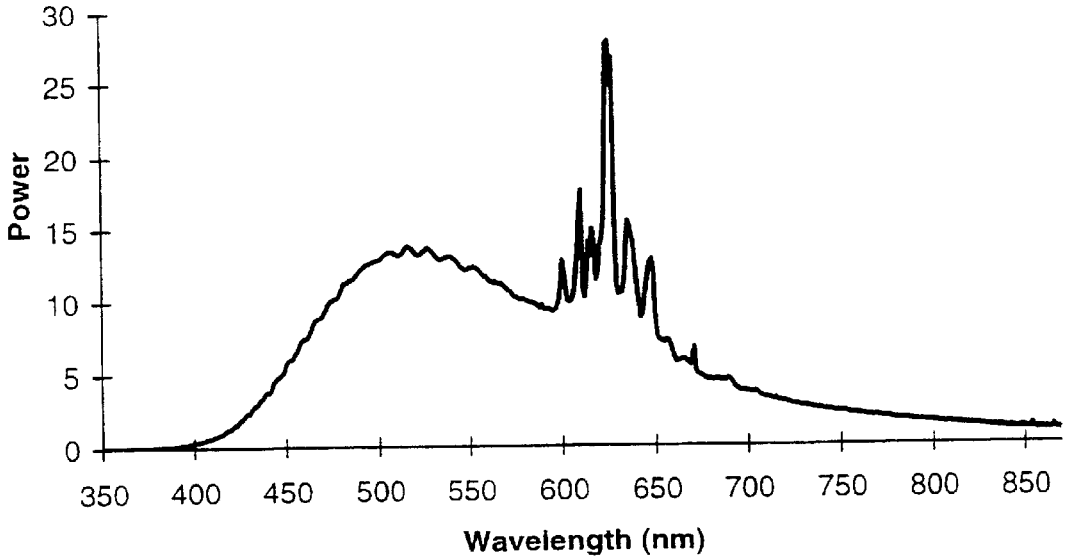
FIG. 7 is a graph of the spectrum of a lamp having a selenium and $CaBr_2$ fill.

FIG. 7 shows the spectrum of a selenium/calcium bromide bulb (about 0.82 mg/cc Se, about 0.27 mg/cc $CaBr_2$) which has much more red radiation with a CRI of about 91 and a color temperature of about 4491° K.

Figure 8:
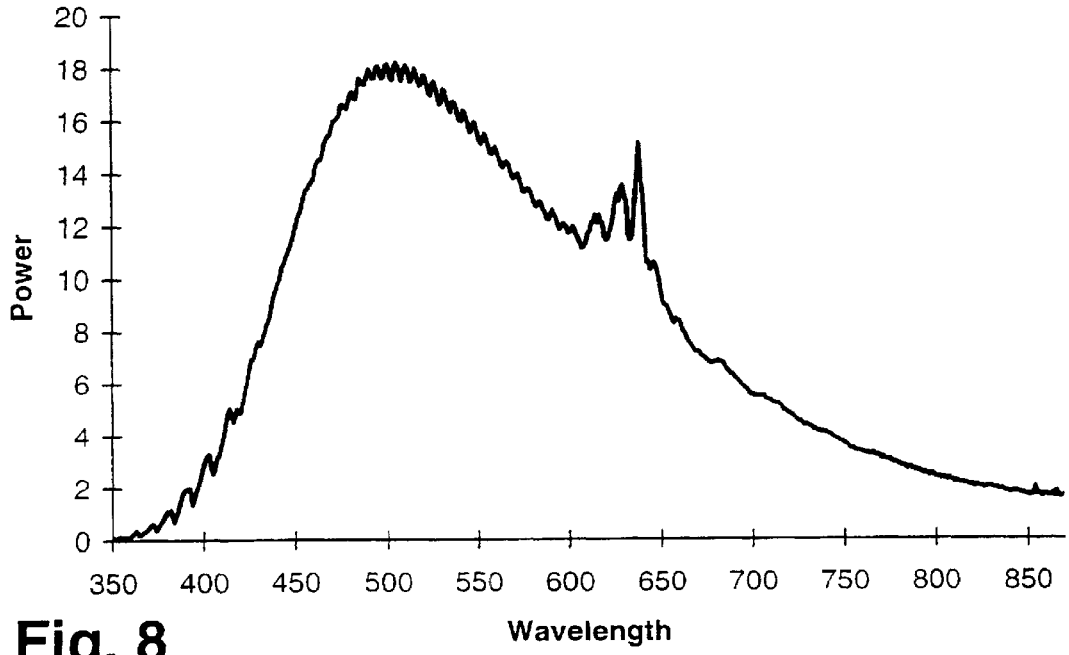
FIG. 8 is a graph of the spectrum of a lamp having a sulfur and $CaI_2$ fill.

FIG. 8 is a graph of the spectrum of lamp having sulfur and calcium iodide fill (about 1.3 mg/cc S, about 0.5 mg/cc $CaI_2$). The CRI is about 88.

Raising the vapor pressure of the calcium bromide increases the amount of red radiation from the molecular radiation of $CaBr_2$. One way to increase vapor pressure is to increase the bulb wall temperature. See, for example, U.S. Pat. No. 4,801,846, col. 6, lines 3–20. Unfortunately, bulb lifetime is compromised because the higher bulb wall temperature may cause the quartz bulb to deteriorate.

In accordance with an aspect of the invention, vapor pressure is increased by adding a metal halide volatilizer to the fill. For example, an article entitled "Vapor-phase Complex Formation of Metal Halides and its Application in High Pressure Discharge Lamps," written by L. Rehder and I. Wilson, Proceedings of the Symposium on High Temperature Metal Halide Chemistry (1978, pp. 71–79), incorporated herein by reference, discloses increasing the vapor pressure of calcium halides by the addition of a second halide capable of forming higher volatility halide complexes.

The addition of the metal halide volatilizer increases the vapor pressure of the calcium halide without having to substantially increase the bulb wall temperature. The volatile halides include aluminum halides, gallium halides, germanium halides, indium halides, tin halides, and iron halides. While the calcium and/or strontium halides may be used without metal halide volatilizers, the use of such compounds enhances performance. Advantageously, CRI maintenance may also be improved.

Figure 9:
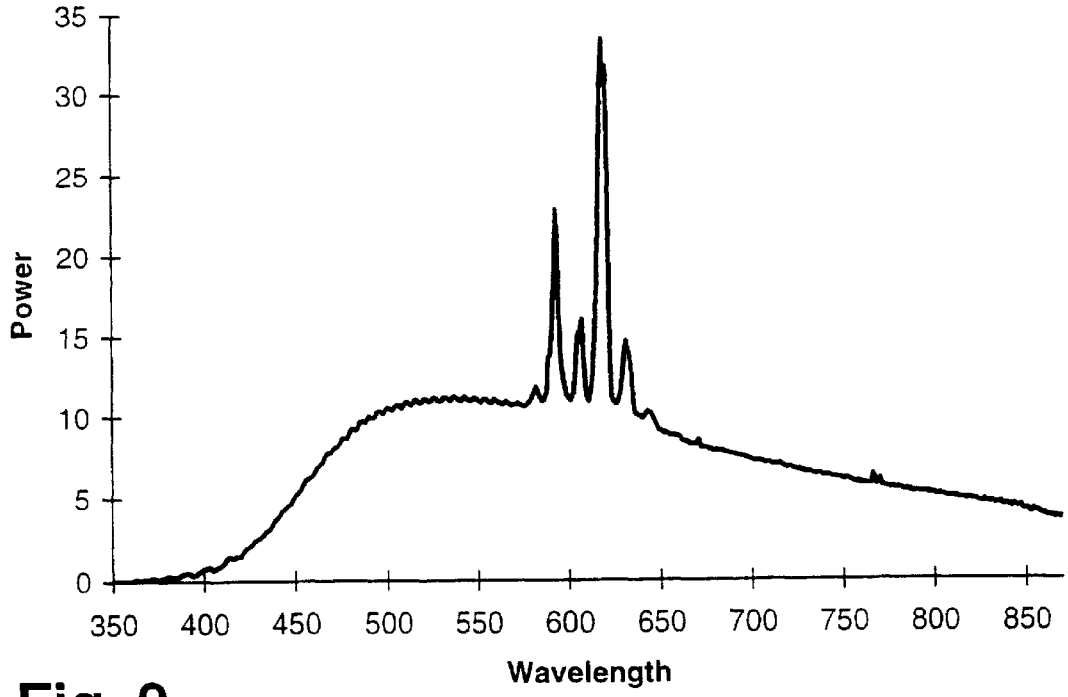
FIG. 9 is a graph of the spectrum of a lamp having a sulfur, $CaBr_2$, and $AlCl_3$ fill.

FIG. 9 shows the spectrum of a 35 mm OD sphere bulb with about 1.28 mg/cc sulfur, about 0.006 mg/cc $CaBr_2$ and about 0.53 mg/cc $AlCl_3$. The molecular radiation from the calcium halide is enhanced dramatically. A low color temperature, high efficiency lamp is provided with an excellent color rendering index of about 93 and a color temperature of about 3678° K. The microwave efficacy is about 123 lumen per watt (LPW). Among all volatile halides, $AlCl_3$ is the most effective volatilizer to bring up the vapor pressure of calcium halides. $AlCl_3$ is not preferred, however, for long-life quartz lamps because of its reaction with the bulb material. For a mixture of sulfur, calcium halides and $AlCl_3$, a wide range variation of calcium halide dosages will provide the desired molecular radiation from calcium halides, for example, from about 0.001 mg/cc to about 1 mg/cc. The amounts of dosed compounds depend on the bulb size, and the foregoing range is applicable for any of the examples depicted in FIGS. 9–16.

In addition to using the volatilizer, vapor pressure can be further increased as noted above by increasing the bulb wall temperature (e.g. by increasing the power density), resulting in a further improved CRI at the expense of a potentially shorter bulb life.

Figure 10:
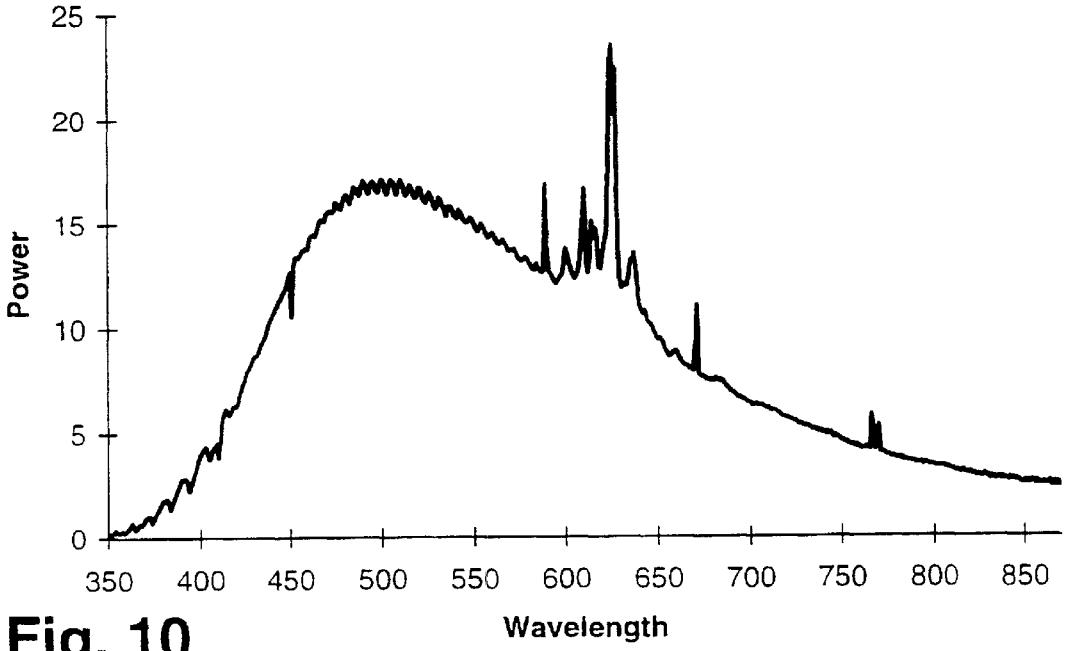
FIG. 10 is a graph of the spectrum of a first lamp having a sulfur, $CaBr_2$, and $InBr_3$ fill.

FIG. 10 shows the spectrum of an about 35 mm OD sphere bulb with a fill of about 1.06 mg/cc sulfur, about 0.053 mg/cc $CaBr_2$, about 0.11 mg/cc $InBr_3$, and about 50 Torr Argon. The molecular radiation from $CaBr_2$ contributes to an excellent color rendering lamp. A high efficiency lamp with a color rendering index of about 94 is provided with all eight color rendering indices being above 90 and a color temperature of about 5621° K. The microwave efficacy is about 126 lumen per watt (LPW).

Figure 11:
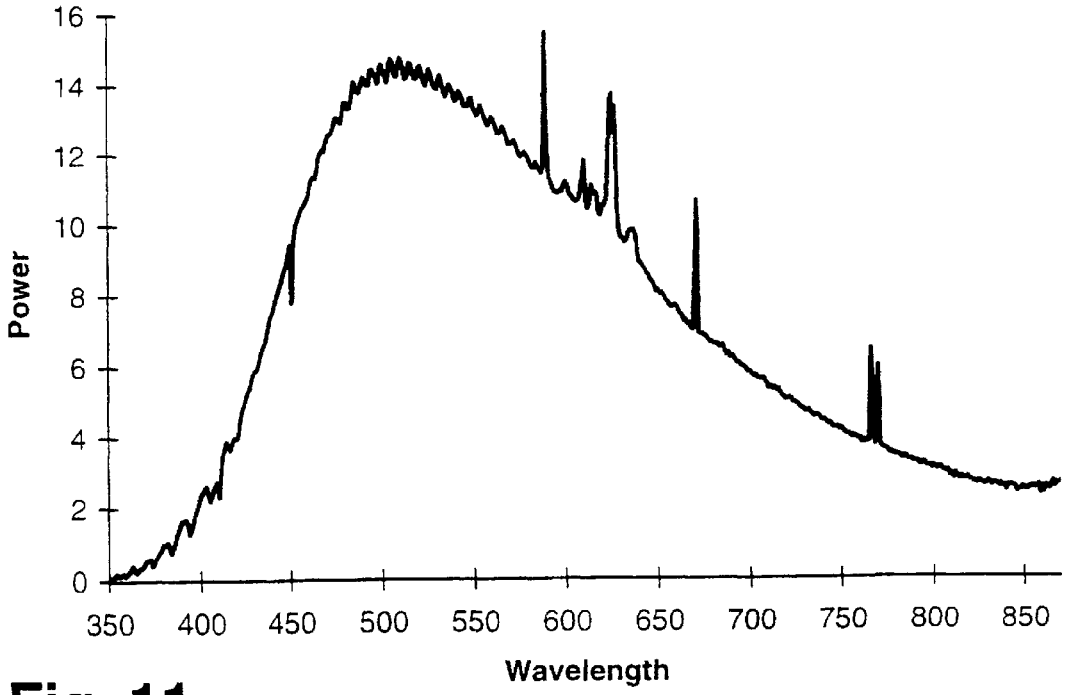
FIG. 11 is a graph of the spectrum of a second lamp having a sulfur, $CaBr_2$, and $InBr_3$ fill.
Figure 11A:
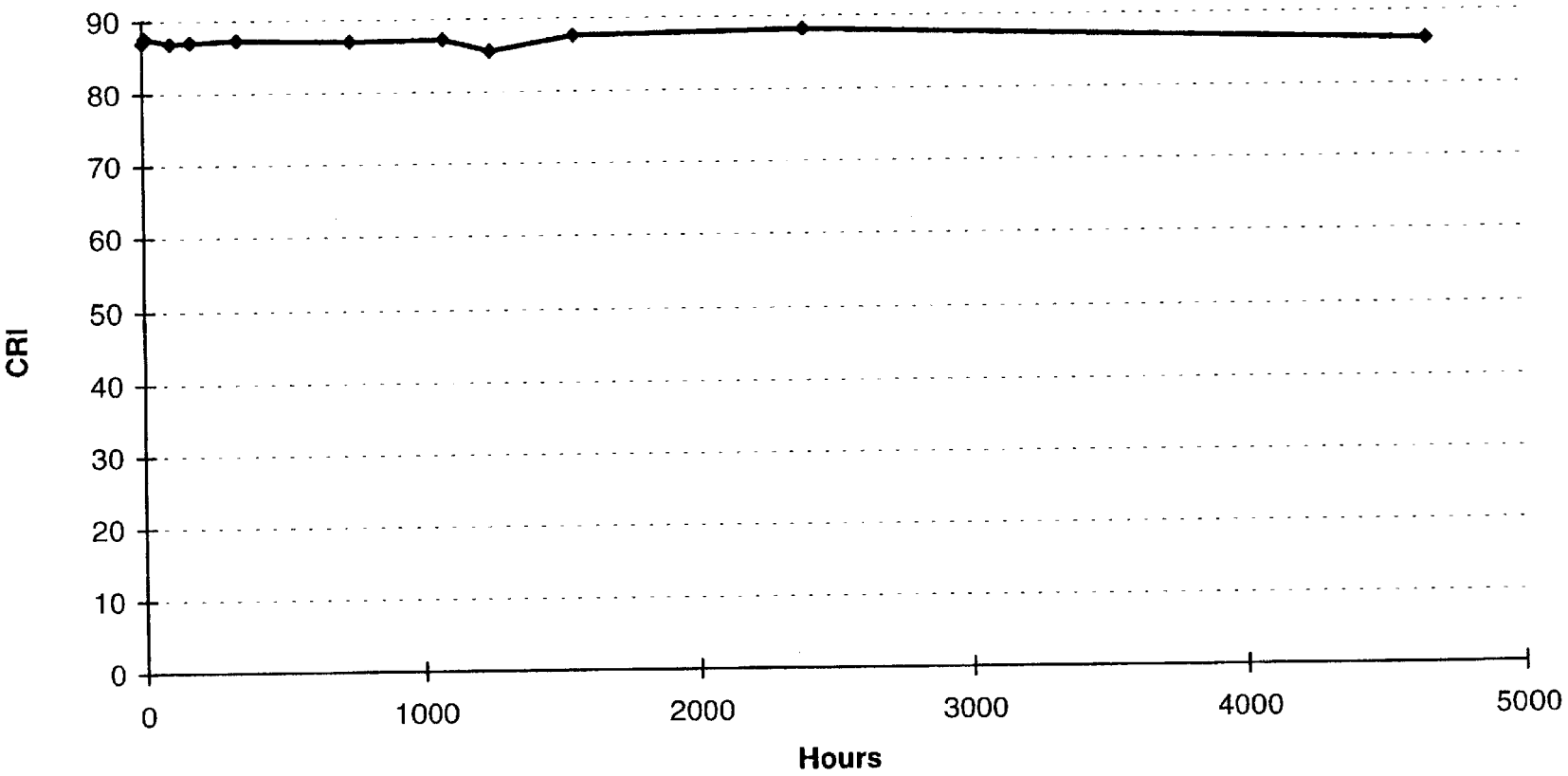

FIG. 11 is a graph of the spectrum of an about 35 mm OD sphere bulb with a fill of about 1.17 mg/cc sulfur, about 0.026 mg/cc $CaBr_2$, about 0.11 mg/cc $InBr_3$, and about 50 Torr Argon. A high efficiency lamp with a color rendering index of about 87 is provided with a color temperature of about 5550° K. The microwave efficacy is about 125 lumen per watt (LPW). FIG. 11A is a graph of CRI life test data for a lamp having the fill described with respect to FIG. 11. As can be seen from FIG. 11A, the CRI is substantially constant over several thousand hours of operation.

Figure 12:
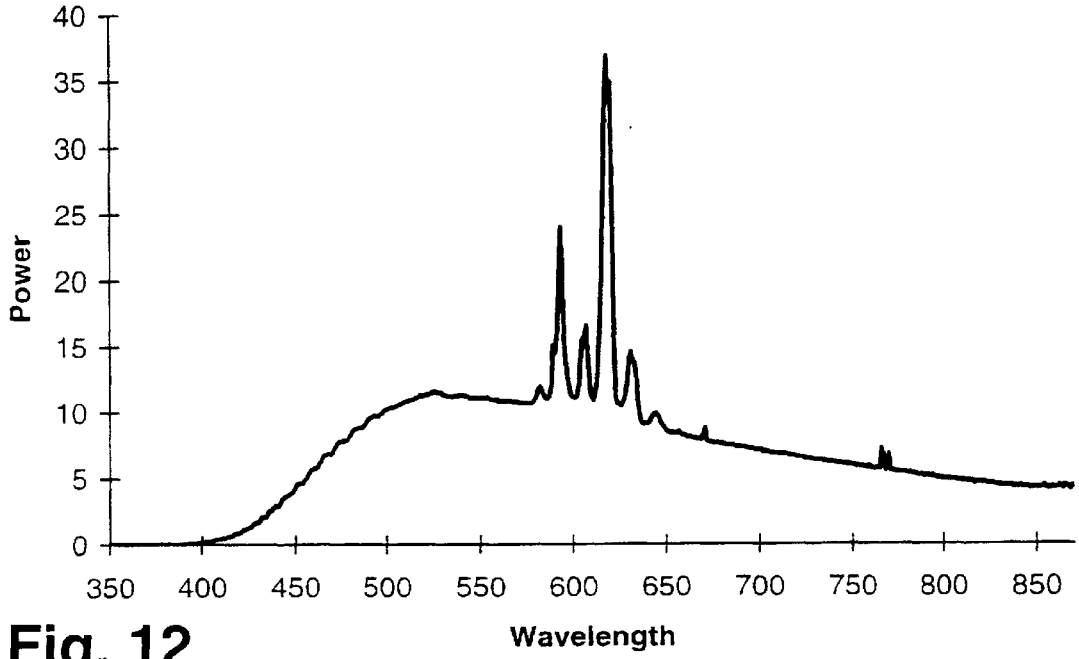
FIG. 12 is a graph of the spectrum of a lamp having a selenium, $CaBr_2$, and $AlCl_3$ fill.

FIG. 12 shows the spectrum of an about 35 mm OD sphere bulb with about 0.64 mg/cc selenium, about 0.053 mg/cc $CaBr_2$ and about 1.06 mg/cc $AlCl_3$. The molecular radiation from the calcium halide is increased significantly. A low color temperature lamp with an excellent color rendering index of about 92 and a color temperature of about 3568° K. is obtained, with the microwave efficacy being about 126 lumen per watt (LPW).

Figure 13:
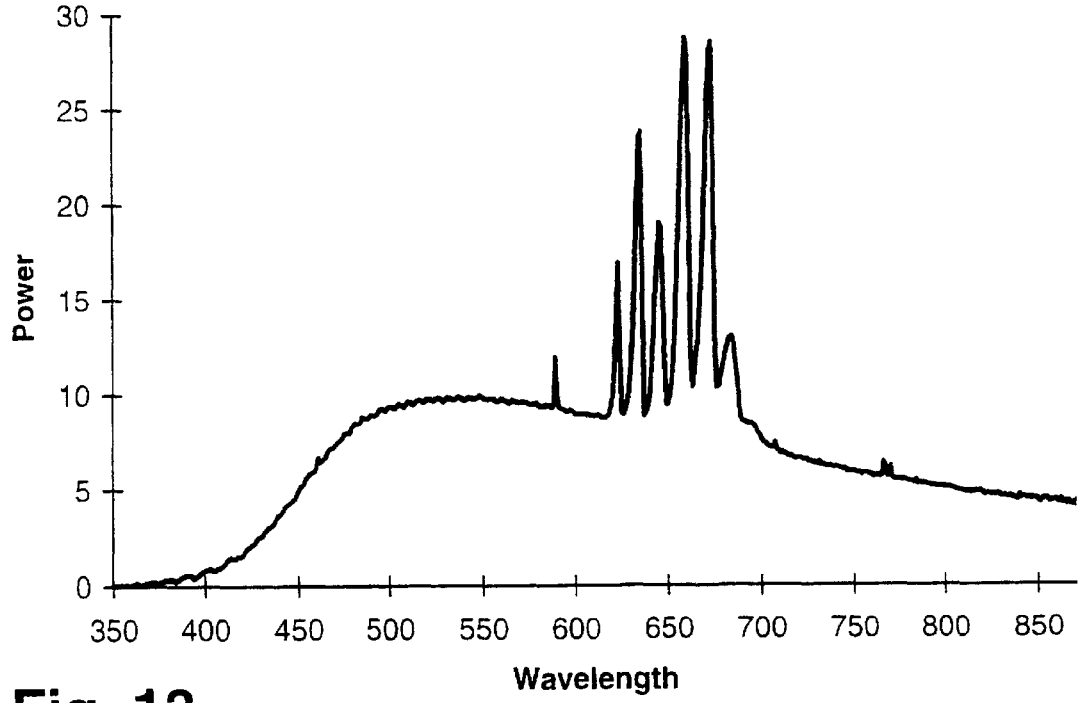
FIG. 13 is a graph of the spectrum of a lamp having a sulfur, $SrBr_2$, and $AlCl_3$ fill.

FIG. 13 shows the spectrum of an about 35 mm OD sphere bulb with about 1.06 mg/cc S, about 0.1 mg/cc $SrBr_2$ and about 0.8 mg/cc $AlCl_3$. The molecular radiation from the strontium halide is enhanced considerably. Red radiation at around 650 nm is provided which is considered excellent for plant growth. Its CRI is about 91, while microwave efficacy is about 105 lumen per watt (LPW).

Figure 14:
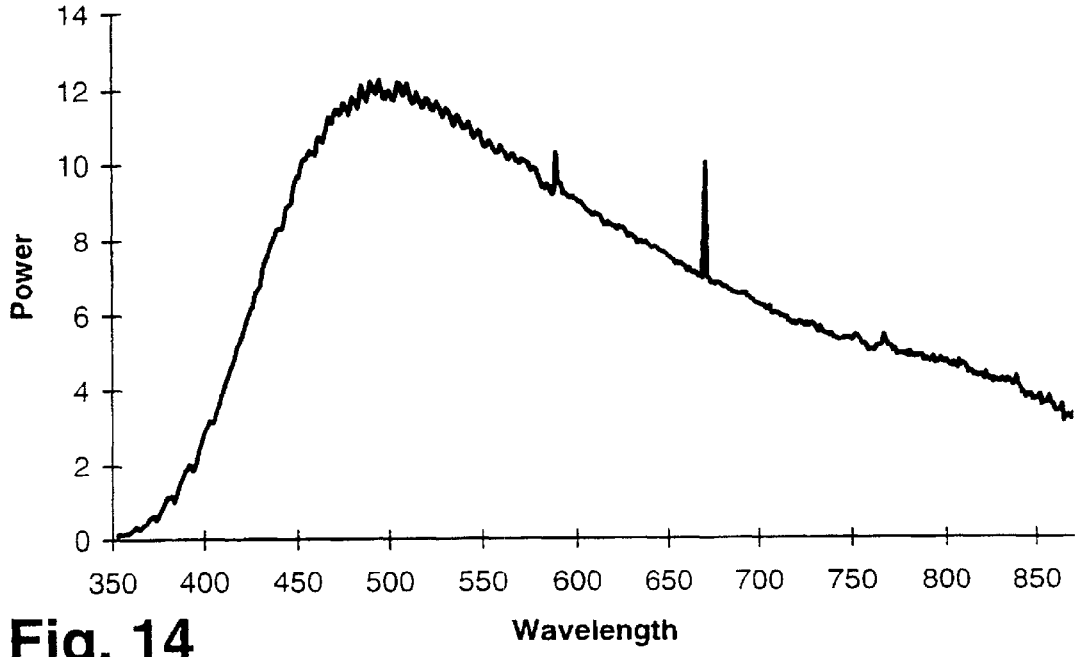
FIG. 14 is a graph of the spectrum of a lamp having a sulfur and $SbBr_3$ fill.

FIG. 14 shows the spectrum of an about 35 mm OD sphere bulb with about 0.64 mg/cc sulfur and about 1.06 mg/cc $SbBr_3$. The addition of $SbBr_3$ reduces the green radiation from the sulfur plasma and spreads the spectrum out with much higher FWHM. An excellent color rendering index of about 91 is obtained, while the color temperature is about 6100° K and the microwave efficacy is about 107 LPW.

Figure 15:
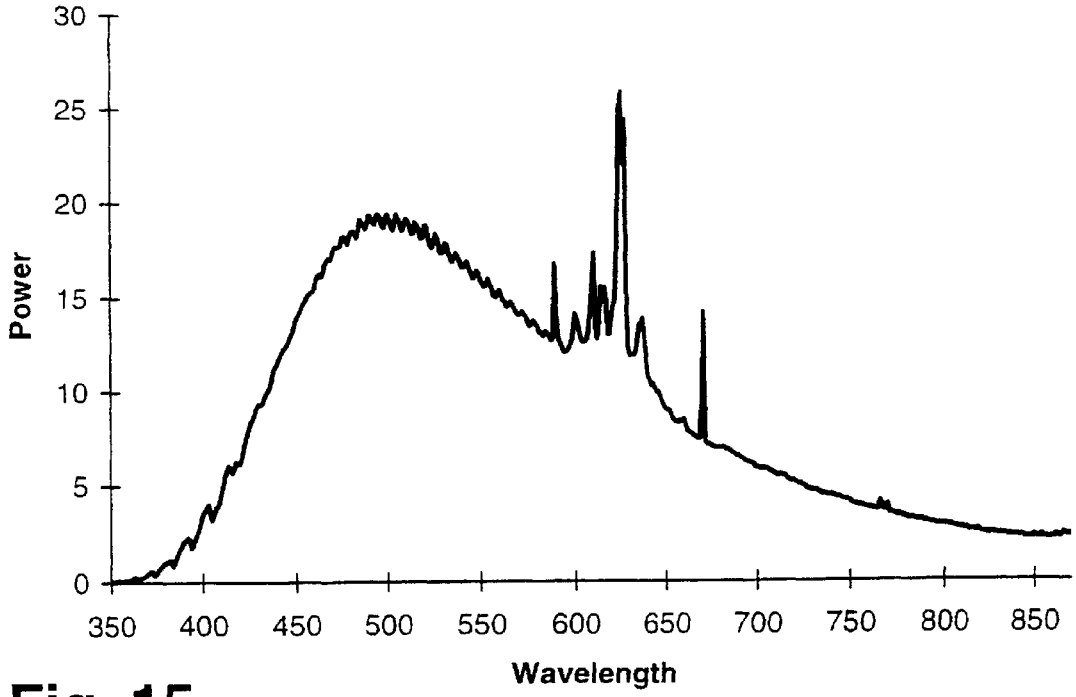
FIG. 15 is a graph of the spectrum of a lamp having a sulfur, $CaBr_2$, and $SnBr_2$ fill.

FIG. 15 shows the spectrum of an about 35 mm OD sphere bulb with about 1.17 mg/cc S, about 0.05 mg/cc $CaBr_2$, and about 0.27 mg/cc $SnBr_2$. The molecular radiation from the calcium halide is enhanced considerably. Red radiation around 625 nm is obtained, which is good for general lighting and plant growth. The CRI is about 90 and the microwave efficacy is about 144 lumen per watt (LPW).

Figure 16:
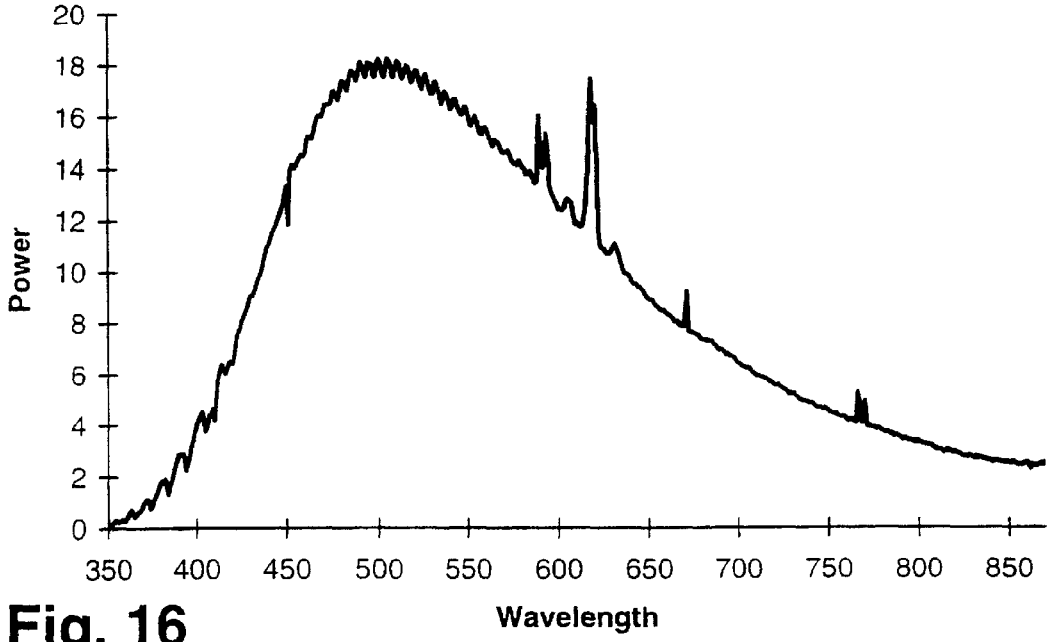
FIG. 16 is a graph of the spectrum of a lamp having a sulfur, $CaCl_2$, and $InCl_3$ fill.

FIG. 16 shows the spectrum of an about 35 mm OD sphere bulb with about 1.1 mg/cc S, about 0.03 mg/cc $CaCl_2$, and about 0.27 mg/cc $InCl_3$. The CRI is about 87 and the microwave efficacy is about 130 lumen per watt (LPW).

Figure 17:
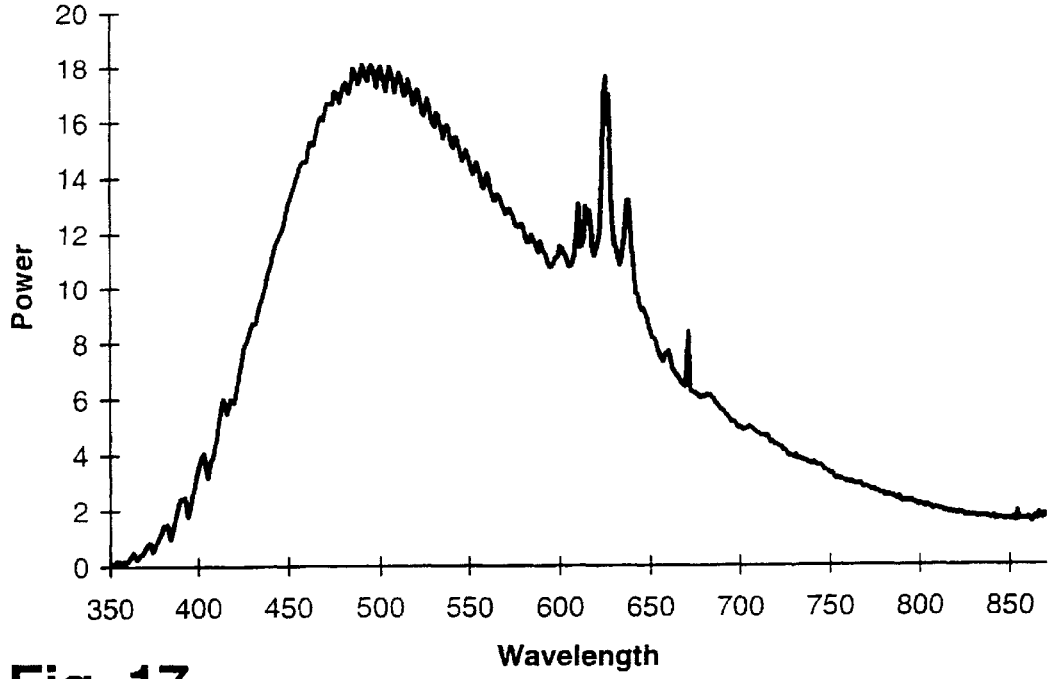
FIG. 17 is a graph of the spectrum of a lamp having a sulfur, $CaBr_2$, and $GeBr_2$ fill.

FIG. 17 shows the spectrum of an about 35 mm OD sphere bulb with about 1.17 mg/cc S, about 0.27 mg/cc $CaBr_2$ and about 0.27 mg/cc $GeBr_2$. The CRI is about 91 and the microwave efficacy is about 139 lumen per watt (LPW).

There thus have been described sulfur and/or selenium lamps having improved color rendering and constituting high quality light sources. While the invention has been described in connection with preferred and illustrative examples, variations will occur to those skilled in the art, and it is therefore understood that the invention herein is defined in the claims which are appended hereto, as well as equivalents. Moreover, the foregoing objects and advantages of the invention are achieved individually and in combination and the present invention should not be construed as requiring two more of the objects and advantages unless expressly required by the claims.

What is claimed is:

1. A discharge lamp for providing visible radiation, comprising:

a lamp envelope which is made of light transmissive material, a fill in said envelope including at least one first member selected from the group consisting of calcium halide and strontium halide, and at least one second member selected from the group consisting of elemental sulfur and elemental selenium in gaseous form which is obtainable when the fill is excited by sufficient power in operation, in an amount such that the excited fill emits a discharge of visible radiation from the selected members with substantially all of the radiation being molecular radiation which is emitted in the visible region of the spectrum; and means for exciting the fill to cause the discharge, wherein the first member operates at a vapor pressure which provides a significant amount of radiation in the red region of the spectrum from the first member and the overall spectrum has a color rendering index of about 87 or more.

2. The discharge lamp bulb as recited in claim 1, wherein said calcium halide is one of $CaBr_2$, $CaI_2$, and $CaCl_2$, and said strontium halide is one of $SrBr_2$, $SrI_2$, and $SrCl_2$.

3. The discharge lamp bulb as recited in claim 2, wherein the concentration of said sulfur in said fill is between about 0.1 mg/cc and 5 mg/cc, the concentration of said selenium is between about 0.05 mg/cc and 2 mg/cc, and the concentration of each of said $CaBr_2$ and $SrBr_2$ is between about 0.001 mg/cc and 1 mg/cc.

4. The discharge lamp bulb as recited in claim 1, wherein said bulb is electrodeless.

5. The discharge lamp bulb as recited in claim 1, wherein said bulb has electrodes.

6. A discharge lamp bulb, comprising:

a lamp envelope which is made of light transmissive material, and a fill in said envelope including at least one first member selected from the group consisting of calcium halide and strontium halide, and at least one second member selected from the group consisting of elemental sulfur and elemental selenium in gaseous form which is obtainable when the fill is excited by sufficient power in operation, in an amount such that the excited fill emits a discharge of visible radiation from the selected members with substantially all of the radiation being molecular radiation which is emitted in the visible region of the spectrum wherein said fill also includes a metal halide volatilizer comprised of at least one of aluminum halide, gallium halide, germanium halide, indium halide, tin halide, and iron halide, or compounds there of, wherein the concentration of said sulfur in said fill is between about 0.1 mg/cc and 5 mg/cc, the concentration of said selenium is between about 0.05 mg/cc and 2 mg/cc, the concentration of each of said calcium halide and said strontium halide is between about 0.001 mg/cc and 1 mg/cc, and the concentration of each metal halide volatilizer compound is between about 0.01 mg/cc and 2 mg/cc.

7. The discharge lamp bulb as recited in claim 6, wherein the metal halide volatilizer compound comprises a tri-halide.

8. The discharge lamp bulb as recited in claim 6, wherein the metal halide volatilizer compound comprises aluminum tri-chloride.

9. A discharge lamp for providing visible radiation, comprising, an electrodeless lamp envelope which is made of light transmissive material, a fill in said envelope including at least one member of the group consisting of $CaBr_2$ and $SrBr_2$, a metal halide volatilizer, and at least one member selected from the group consisting of elemental sulfur and elemental selenium in gaseous form which is obtainable when the fill is excited by sufficient power in operation, in an amount such that the excited fill emits a discharge of visible radiation from the selected members with substantially all of the radiation being molecular radiation which is emitted in the visible region of the spectrum, wherein the concentration of said sulfur in said fill is between about 0.5 mg/cc and 5 mg/cc, the concentration of said selenium in said fill is between about 0.2 mg/cc and 2 mg/cc, and the concentration of each of said $CaBr_2$ and $SrBr_2$ is between about 0.001 mg/cc and 1 mg/cc and the concentration of said metal halide volatilizer compound is between about 0.05 mg/cc and 2 mg/cc, and means for exciting said fill with microwave or RF power.

10. The discharge lamp as recited in claim 9, wherein the member selected from the group of $CaBr_2$ and $SrBr_2$ operates at a vapor pressure which provides a significant amount of radiation in the red region of the spectrum from the selected member and the overall spectrum has a color rendering index of about 87 or more.

11. The discharge lamp as recited in claim 9, wherein the metal halide volatilizer compound comprises a metal tri-halide.

12. The discharge lamp as recited in claim 9, wherein the metal halide volatilizer compound comprises aluminum tri-chloride.

13. The discharge lamp as recited in claim 9, wherein the metal halide volatilizer compound comprises indium tri-bromide.

* * * * *